US009035554B2

(12) United States Patent
Huang et al.

(10) Patent No.: US 9,035,554 B2
(45) Date of Patent: May 19, 2015

(54) ADJUSTABLE THREE-STAGE LIGHT EMITTING DIODE BULB

(71) Applicants: Tai-Hsiang Huang, Tainan (TW); Kuan-Hsiang Huang, Tainan (TW)

(72) Inventors: Tai-Hsiang Huang, Tainan (TW); Kuan-Hsiang Huang, Tainan (TW)

( * ) Notice: Subject to any disclaimer, the term of this patent is extended or adjusted under 35 U.S.C. 154(b) by 0 days.

(21) Appl. No.: 13/912,480

(22) Filed: Jun. 7, 2013

(65) Prior Publication Data

US 2014/0361692 A1 Dec. 11, 2014

(51) Int. Cl.
*H05B 41/00* (2006.01)
*H05B 33/08* (2006.01)

(52) U.S. Cl.
CPC ..... *H05B 33/0845* (2013.01)

(58) Field of Classification Search
CPC ..... H05B 33/0803; H05B 33/0815; G09G 2300/0842
USPC ..... 315/185 R, 169.3, 291
See application file for complete search history.

(56) References Cited

U.S. PATENT DOCUMENTS

| | | | | |
|---|---|---|---|---|
| 6,043,609 | A * | 3/2000 | George et al. | 315/169.3 |
| 8,698,407 | B1 * | 4/2014 | Chen et al. | 315/193 |
| 8,704,446 | B2 * | 4/2014 | Gibbs | 315/122 |
| 8,773,031 | B2 * | 7/2014 | Sadwick et al. | 315/224 |
| 2007/0024213 | A1 * | 2/2007 | Shteynberg et al. | 315/291 |
| 2012/0248986 | A1 * | 10/2012 | Gibbs | 315/122 |
| 2012/0299500 | A1 * | 11/2012 | Sadwick et al. | 315/224 |
| 2013/0106311 | A1 * | 5/2013 | Kato et al. | 315/307 |
| 2013/0234609 | A1 * | 9/2013 | Akiyama | 315/185 R |
| 2013/0300308 | A1 * | 11/2013 | Sadwick | 315/224 |
| 2013/0334974 | A1 * | 12/2013 | Tamura et al. | 315/185 R |

* cited by examiner

*Primary Examiner* — Thuy Vinh Tran
*Assistant Examiner* — Syed M Kaiser
(74) *Attorney, Agent, or Firm* — Rosenberg, Klein & Lee

(57) ABSTRACT

A three-stage power adjustable Light Emitting Diode bulb includes a first resistance and a second resistance which is electrically connected to the first resistance in parallel. The first resistance and the second resistance are connected to a rectifier. Multiple Light Emitting Diode units and a limiting resistance are connected between the positive and negative poles of the rectifier. The Light Emitting Diode units each have multiple Light Emitting Diodes. The electric energy consumption of the Light Emitting Diode bulb is reduced and the life of use of the Light Emitting Diode bulb is prolonged. The resistance value of the first and second resistance can be adjusted to have different luminous powers.

2 Claims, 5 Drawing Sheets

ADJUSTABLE THREE-STAGE LIGHT EMITTING DIODE BULB

BACKGROUND OF THE INVENTION

1. Fields of the Invention

The present invention relates to a Light Emitting Diode bulb (LED bulb), and more particularly, to a three-stage power adjustable Light Emitting Diode bulb with adjustable resistances to have different output power.

2. Descriptions of Related Art

The conventional three-stage adjustable bulb 31 comprises a first Tungsten-filament 311 of lower power and a second Tungsten-filament 312 of high power located in the bulb 31. The circuit for the conventional three-stage adjustable bulb 31 is disclosed in FIG. 5. A three-stage switch 32 is cooperated with the three-stage adjustable bulb 31. The first switch of the three-stage switch 32 is connected to the first Tungsten-filament 311 and the second switch of the three-stage switch 32 is connected to the second Tungsten-filament 312. The third switch of the three-stage switch 32 is connected to the first and second Tungsten-filaments 311, 312 in parallel. When the users switch to the first switch of the three-stage switch 32, the first Tungsten-filament 311 of lower power is activated. When the users switch to the second switch of the three-stage switch 32, the second Tungsten-filament 312 of lower power is activated. When the users switch to the third switch of the three-stage switch 32, the first and second Tungsten-filaments 311, 312 are both activated to have the maximum output power.

However, the Tungsten-filaments consume significant electric power energy and have shorter life. The conventional three-stage adjustable bulb using Tungsten-filaments cannot change their luminous power according to practical needs.

The present invention intends to provide a three-stage power adjustable Light Emitting Diode bulb which has adjustable resistances to have different output power.

SUMMARY OF THE INVENTION

The present invention relates to a three-stage power adjustable Light Emitting Diode bulb and comprises a first resistance and a second resistance which is electrically connected to the first resistance in parallel. The first resistance and the second resistance are connected to a rectifier. Multiple Light Emitting Diode units and a limiting resistance are connected between the positive and negative poles of the rectifier. The Light Emitting Diode units each have multiple Light Emitting Diodes.

Preferably, a fuse is connected between the first and second resistances and the rectifier.

The primary object of the present invention is to provide a three-stage power adjustable Light Emitting Diode bulb wherein the electric energy consumption of the Light Emitting Diode bulb is reduced and the life of use of the Light Emitting Diode bulb is prolonged. The resistance value of the first and second resistance can be adjusted to have different luminous powers.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
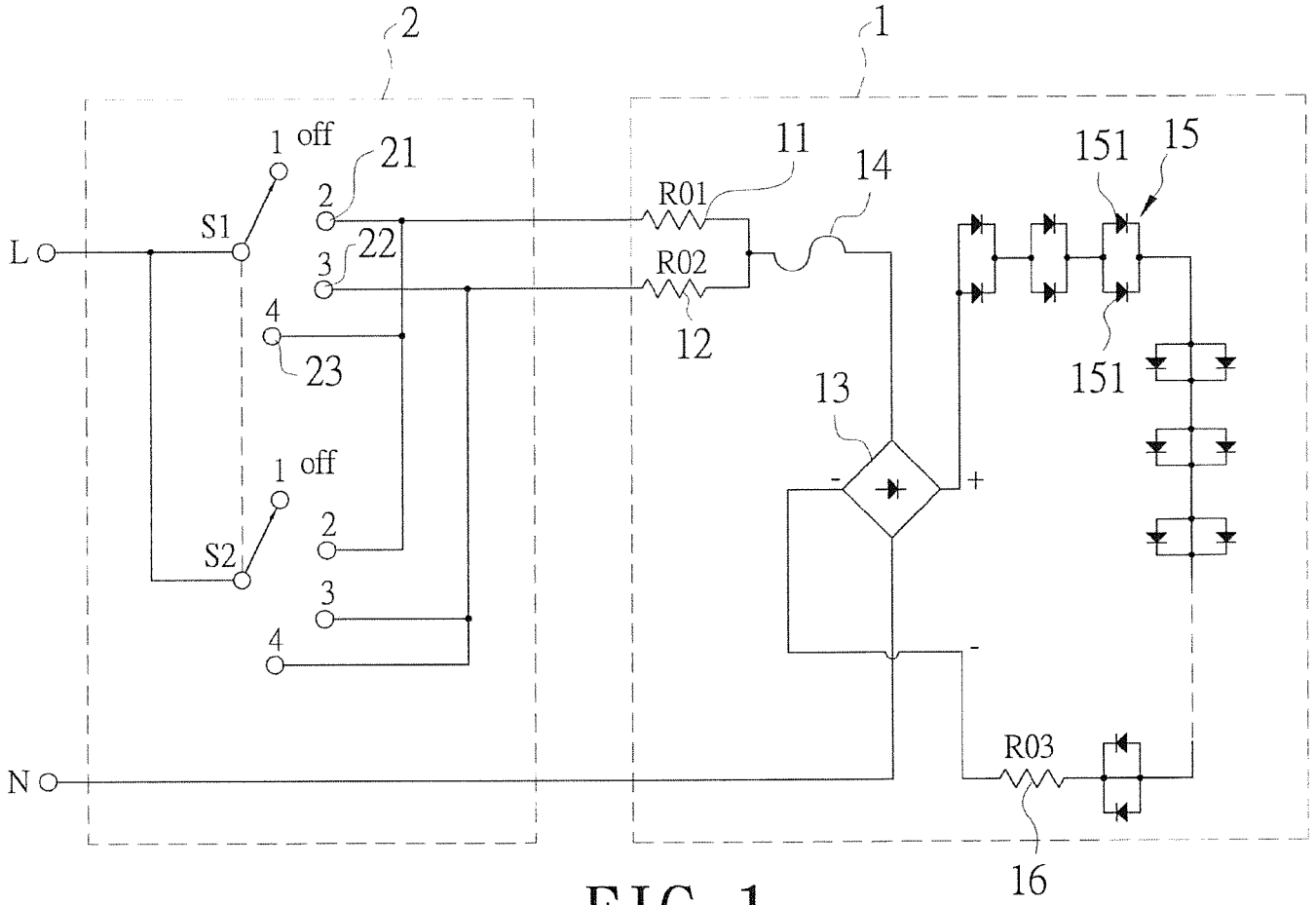
FIG. 1 shows the circuit of the three-stage power adjustable Light Emitting Diode bulb of the present invention.

Referring to FIG. 1, a three-stage power adjustable Light Emitting Diode bulb 1 of the present invention is cooperated with a three-stage switch 2 and comprises a first resistance 11 and a second resistance 12 which is electrically connected to the first resistance 11 in parallel. The first resistance 11 and the second resistance 12 are connected to a rectifier 13. A fuse 14 is connected between the first and second resistances 11, 12 and the rectifier 13. Multiple Light Emitting Diode units 15 and a limiting resistance 16 are connected between positive and negative poles of the rectifier 13. The Light Emitting Diode units 15 each have multiple Light Emitting Diodes 151.

A first switch 21 of the three-stage switch 2 is connected to the first resistance 11 of the three-stage power adjustable Light Emitting Diode bulb 1. A second switch 22 of the three-stage switch 2 is connected to the second resistance 12 of the three-stage power adjustable Light Emitting Diode bulb 1. A third switch 23 of the three-stage switch 2 is connected to both of the first and second resistances 11, 12 of the three-stage power adjustable Light Emitting Diode bulb 1.

Figure 2:
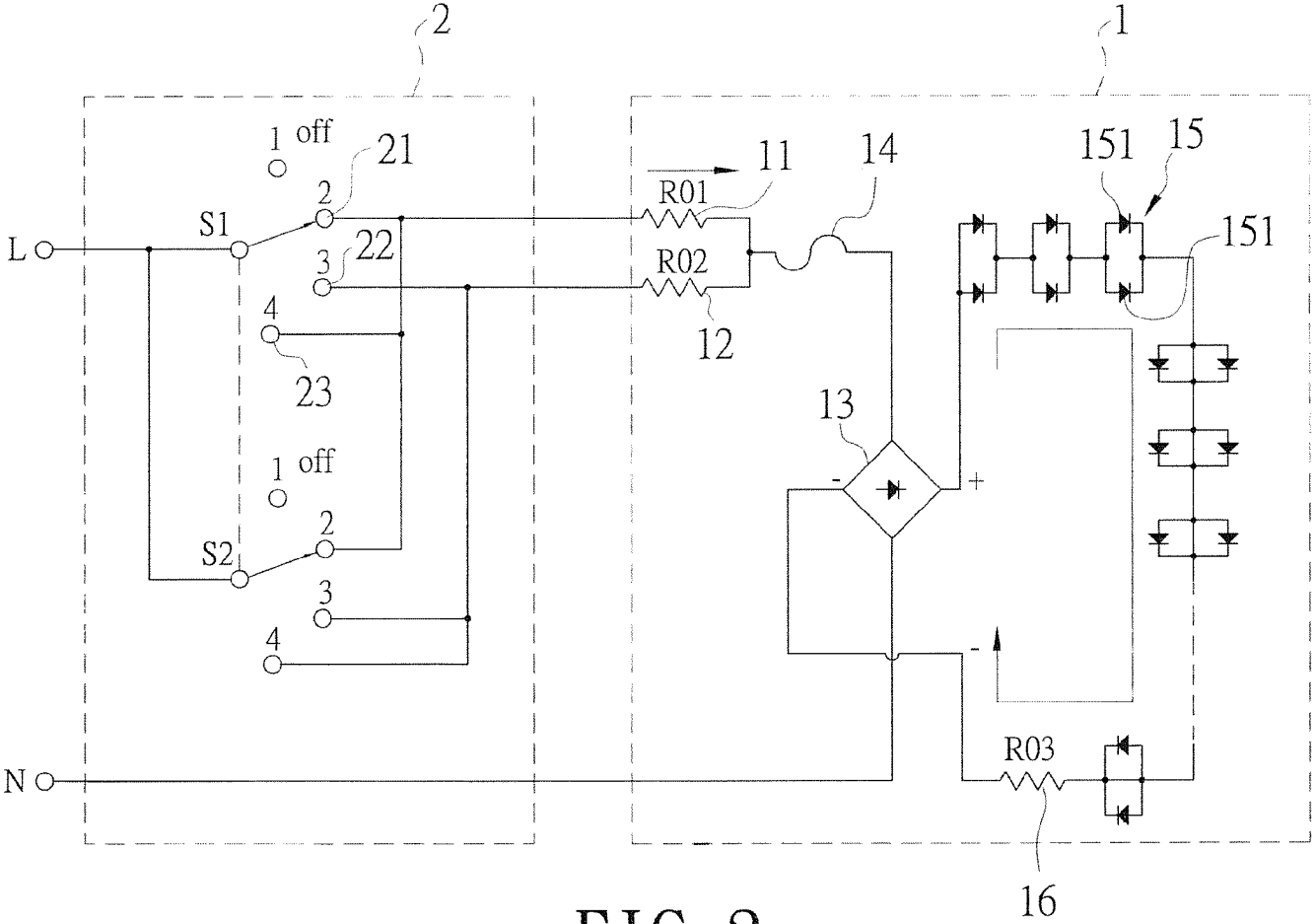
FIG. 2 shows the circuit of the first way of use of the three-stage power adjustable Light Emitting Diode bulb of the present invention.
Figure 3:
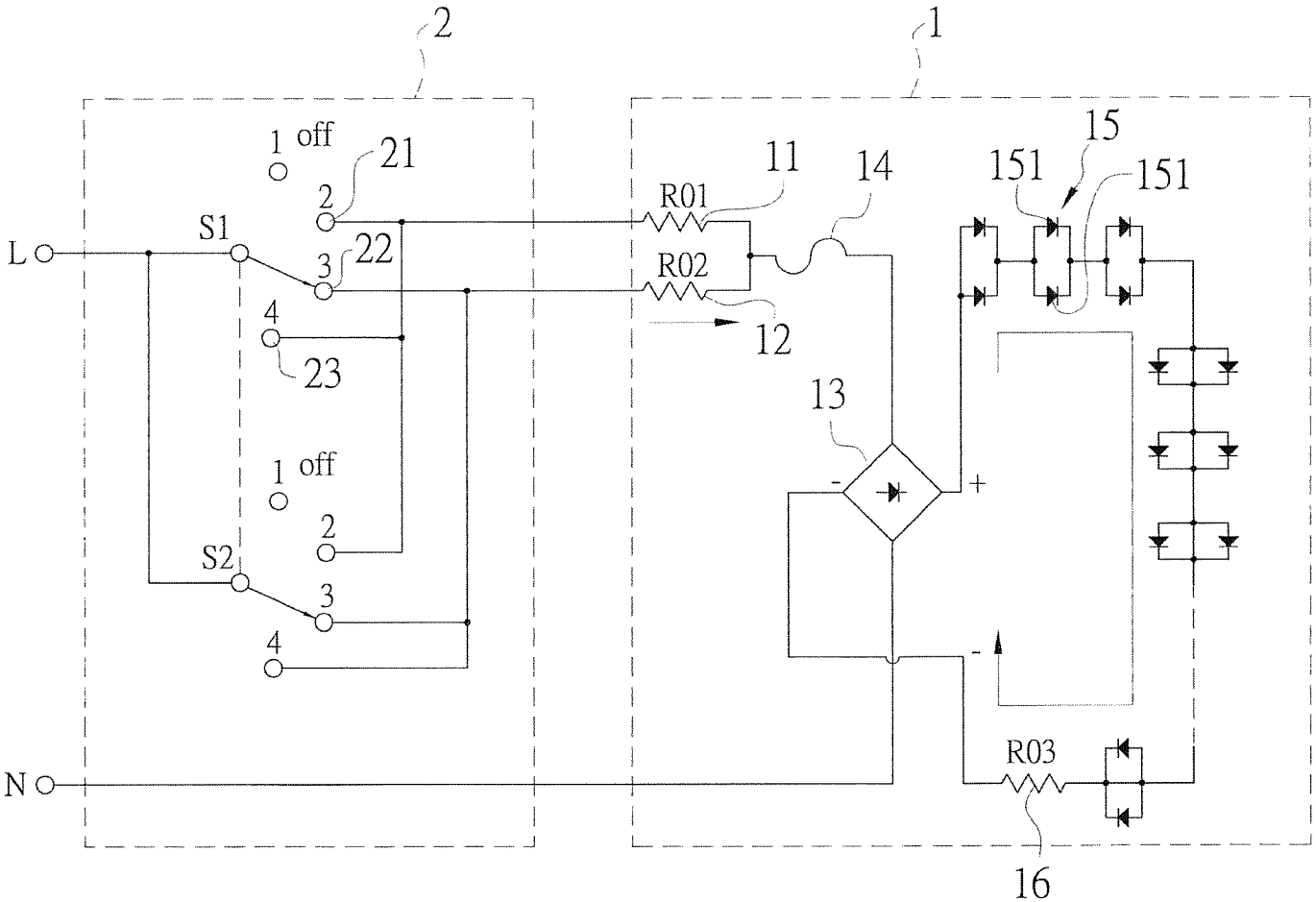
FIG. 3 shows the circuit of the second way of use of the three-stage power adjustable Light Emitting Diode bulb of the present invention.
Figure 4:
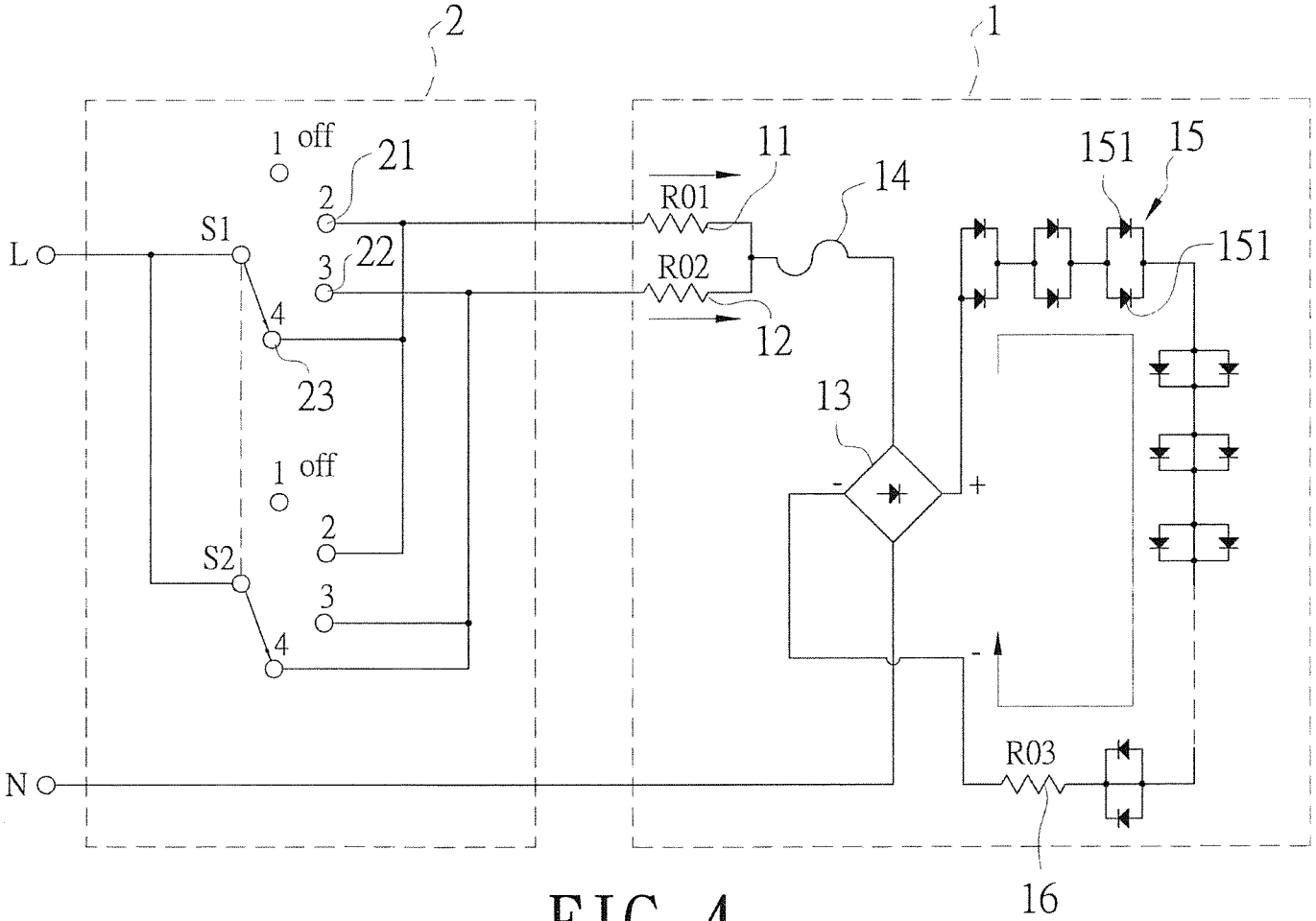
FIG. 4 shows the circuit of the third way of use of the three-stage power adjustable Light Emitting Diode bulb of the present invention.
Figure 5:
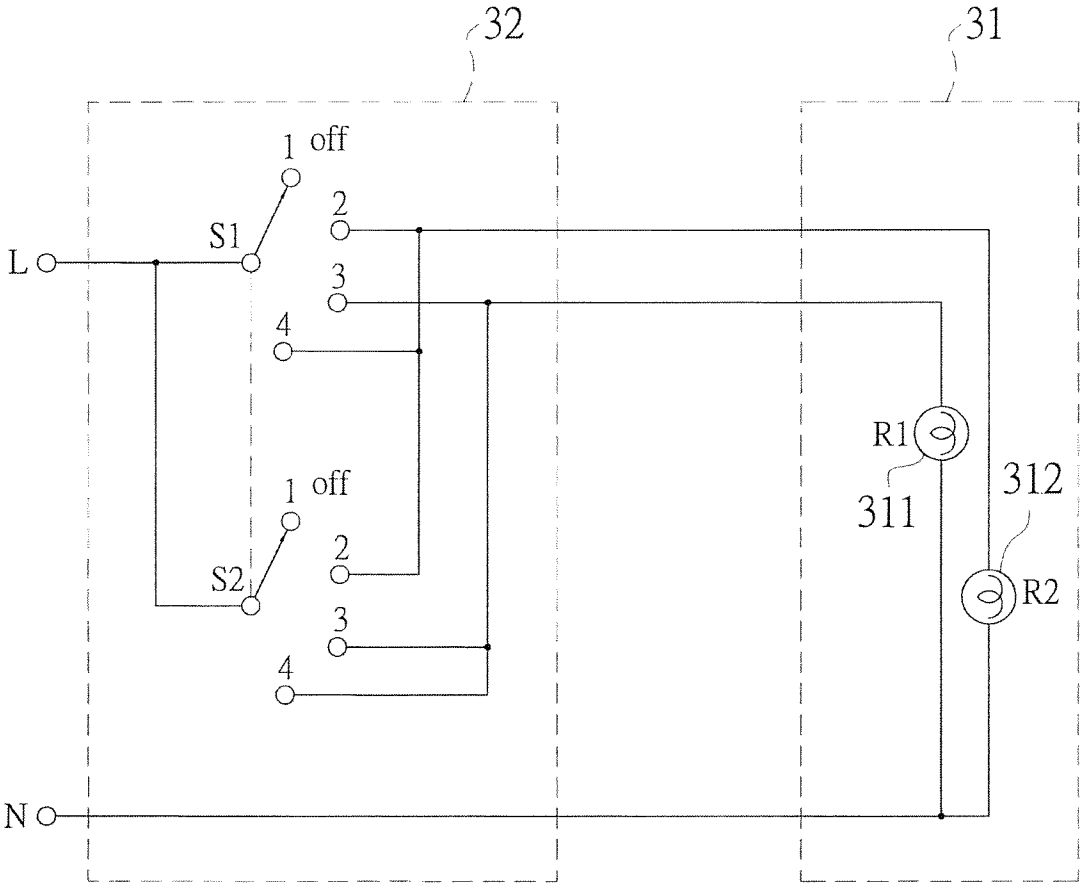
FIG. 5 (PRIOR ART)
FIG. 5 shows the circuit of the conventional three-stage adjustable bulb.

When the user switches to the first switch 21, as shown in FIG. 2, the current passes through the first resistance 11 of the three-stage power adjustable Light Emitting Diode bulb 1, and is rectified by the rectifier 13 so as to provide proper power to the Light Emitting Diodes 151 of the Light Emitting Diode units 15. As shown in FIG. 3, when the user switches to the second switch 22, the current passes through the second resistance 12 of the three-stage power adjustable Light Emitting Diode bulb 1, and is rectified by the rectifier 13 so as to provide proper power to the Light Emitting Diodes 151 of the Light Emitting Diode units 15. Because the first and second resistances 11, 12 have different resistance values, so that the voltages provided to the rectifier 13 are different, so that the Light Emitting Diodes 151 of the Light Emitting Diode units 15 provides different illuminations when the second or third switch 22, 23 is set. As shown in FIG. 4, when the user switches to the third switch 23, because the second resistance 12 is electrically connected to the first resistance 11 in parallel, the current passes through the first and second resistances 11, 12 and reduce the resistance value. The current is then rectified by the rectifier 13 so as to provide proper power to the Light Emitting Diodes 151 of the Light Emitting Diode units 15. In this status, the three-stage power adjustable Light Emitting Diode bulb 1 has the maximum illumination feature. It is noted that the resistance values of the first or second resistance 11, 12 can be adjusted according to the needs of the market or consumers to provide the three-stage power adjustable Light Emitting Diode bulb 1 with proper illumination.

The three-stage power adjustable Light Emitting Diode bulb 1 optionally activates the Light Emitting Diodes 151 of the Light Emitting Diode units 15 by operation to the three-stage switch 2 so as to save energy and prolong the life of use.

While we have shown and described the embodiment in accordance with the present invention, it should be clear to those skilled in the art that further embodiments may be made without departing from the scope of the present invention.

What is claimed is:

1. A three-stage power adjustable Light Emitting Diode bulb, comprising:

a first resistance unit electrically connected in parallel to a second resistance unit, said first resistance unit and said second resistance unit having different values, one end of the first resistance unit and one end of the second resistance unit being connected to define a node, the node being connected to an end of a rectifier;

a switch having plurality of stages, said switch being connected to the first and second resistance units, the other end of said first resistance unit being connected to a first one of the plurality of stages of said switch, the other end of said second resistance unit being connected to a second one of the plurality of stages of said switch, and both other ends of said first resistance unit and said second resistance unit are connected to a third one of the plurality of stages of said switch, whereby enabling said first one of the plurality of stages of said switch passes current through only said first resistance unit, enabling said second one of the plurality of stages of said switch passes current through only said second resistance unit, and enabling said third one of the plurality of stages of said switch passes current through both said first resistance unit and said second resistance unit; and multiple Light Emitting Diode units and a limiting resistance connected between positive and negative poles of the rectifier, the Light Emitting Diode units each having multiple Light Emitting Diodes.

2. The bulb as claimed in claim 1, wherein a fuse is connected between the first and second resistance units and the rectifier.

* * * * *